US011002490B2

(12) United States Patent
Siegel et al.

(10) Patent No.: US 11,002,490 B2
(45) Date of Patent: May 11, 2021

(54) HEAT EXCHANGER WITH HOUSING PARTS CONNECTED BY FLANGE RING CONNECTION

(71) Applicant: Mahle International GmbH, Stuttgart (DE)

(72) Inventors: Albrecht Siegel, Ludwigsburg (DE); Leander Horntasch, Erdmannhausen (DE); Pascal Lerchner, Kornwestheim (DE); Simon Hund, Stuttgart (DE)

(73) Assignee: Mahle International GmbH

( * ) Notice: Subject to any disclaimer, the term of this patent is extended or adjusted under 35 U.S.C. 154(b) by 40 days.

(21) Appl. No.: 15/533,921

(22) PCT Filed: Dec. 7, 2015

(86) PCT No.: PCT/EP2015/078829
§ 371 (c)(1),
(2) Date: Jun. 7, 2017

(87) PCT Pub. No.: WO2016/091806
PCT Pub. Date: Jun. 16, 2016

(65) Prior Publication Data

US 2017/0336148 A1 Nov. 23, 2017

(30) Foreign Application Priority Data

Dec. 8, 2014 (DE) ..... 10 2014 225 159.1

(51) Int. Cl.
*F28D 7/16* (2006.01)
*F28F 9/00* (2006.01)
(Continued)

(52) U.S. Cl.
CPC ..... *F28D 7/1684* (2013.01); *F28D 21/0003* (2013.01); *F28F 9/00* (2013.01);
(Continued)

(58) Field of Classification Search
CPC ..... F28D 7/1684; F28D 21/0003; F28F 9/00; F28F 9/005; F28F 9/0236; F28F 9/26;
(Continued)

(56) References Cited

U.S. PATENT DOCUMENTS 3,937,276 A 2/1976 Ostwald
4,825,942 A * 5/1989 Helberg ..... F28F 9/0219 122/511
(Continued)

FOREIGN PATENT DOCUMENTS

DE 3435093 A1 4/1986
DE 102010025031 A1 12/2011
(Continued)

OTHER PUBLICATIONS

English abstract for EP-2378233.
English abstract for EP-2559962.

*Primary Examiner* — Travis C Ruby
(74) *Attorney, Agent, or Firm* — Fishman Stewart PLLC

(57) ABSTRACT

A heat exchanger may include a tubular housing, a flange ring, two bases, and heat exchanger tubes that run through the housing and are each held in the bases at a longitudinal end side. A first flow channel may be formed in the heat exchanger tubes, and a second flow channel may be formed between the heat exchanger tubes and the housing. The housing may be formed from two one-piece and pot-shaped housing parts. Each housing part may have a housing section, a flange ring section, and a base. The two housing parts may be connectable to one another via the two flange ring sections.

14 Claims, 2 Drawing Sheets

(51) Int. Cl.

| | |
|---|---|
| ***F28F 9/02*** | (2006.01) |
| ***F28F 9/26*** | (2006.01) |
| ***F28D 21/00*** | (2006.01) |

(52) U.S. Cl.
CPC ..... *F28F 9/005* (2013.01); *F28F 9/0236* (2013.01); *F28F 9/26* (2013.01); *F28F 2265/26* (2013.01); *F28F 2275/00* (2013.01)

(58) Field of Classification Search
CPC ..... F28F 9/0243; F28F 9/12; F28F 2265/26; F28F 2275/00; F28F 2225/02; F28F 2255/08
See application file for complete search history.

(56) References Cited

U.S. PATENT DOCUMENTS

| | | | | |
|---|---|---|---|---|
| 2007/0107885 | A1 | 5/2007 | Guillaume | |
| 2012/0090818 | A1* | 4/2012 | Dittmann ..... | F02B 29/0462 165/96 |
| 2012/0186780 | A1 | 7/2012 | Ilgner et al. | |
| 2014/0000848 | A1 | 1/2014 | Siegel et al. | |

FOREIGN PATENT DOCUMENTS

| | | | |
|---|---|---|---|
| DE | 102012211311 | A1 | 1/2014 |
| EP | 2378233 | A2 | 10/2011 |
| EP | 2559962 | A2 | 2/2013 |
| GB | 2164738 | A | 3/1986 |
| WO | WO-2003091650 | A1 | 11/2003 |

* cited by examiner

HEAT EXCHANGER WITH HOUSING PARTS CONNECTED BY FLANGE RING CONNECTION

CROSS-REFERENCE TO RELATED APPLICATIONS

This application claims priority to International Patent Application No. PCT/EP2015/078829, filed on Dec. 7, 2015, and German Patent Application No. DE 10 2014 225 159.1, filed on Dec. 8, 2014, the contents of both of which are incorporated herein by reference in their entireties.

TECHNICAL FIELD

The present invention relates to a heat exchanger comprising a tubular housing, a flange ring, two bases and heat exchanger tubes. The invention also relates to a housing part for such a heat exchanger.

BACKGROUND

Known from DE 10 2012 211 311 A1 is a generic heat exchanger configured as an exhaust gas heat exchanger, comprising a housing and a first flow channel through which a first fluid can flow. The first flow channel is in this case formed by the heat exchanger tubes whereas a second flow channel runs between the heat exchanger tubes and the housing. At least one of its end regions the heat exchanger has an at least partially circumferential first flange which is designed in one piece with the exhaust-gas heat exchanger. By integrating the flange into the housing, the complex assembly thereof can be saved.

Known from WO 03/091 650 A1 is an exhaust-gas heat exchanger with an exhaust gas recirculation system which comprises a housing jacket for a coolant and a tube bundle through which exhaust gases flow and around which coolant flows. The tube bundle, the tube bases and the housing jacket in this case form an enclosed force flow. A sliding seating is built into the force flow which is arranged either in the housing jacket or between tube base and housing jacket. This sliding seating can compensate for the different expansions of the tube bundle on the one hand and of the housing jacket on the other hand so that no impermissibly high stresses occur in the components of the heat exchanger.

A disadvantage with heat exchangers from the prior art in general is that the housing thereof is composed of a plurality of individual parts, namely for example of a housing section, a flange ring, two bases and heat exchanger tubes, wherein joints must be produced in each case between these individual parts in order for example to be able to reliably avoid any undesired escape of exhaust gas and/or coolant and therefore any leak of the heat exchanger. However, complex and therefore expensive joining operations are involved in producing these joints. In addition, these joints constitute a potential risk for leak points so that when viewed purely statistically, a plurality of leak points can also occur at a plurality of joints.

SUMMARY

The present invention is therefore concerned with the problem of providing an improved or at least an alternative embodiment for a heat exchanger of the generic type, which in particular ensures a simple and most cost-effective assembly of the heat exchanger and in addition reduces the risk of a leak.

The problem is solved according to the invention by the subject matter of the independent claims. Advantageous embodiments are the subject matter of the dependent claims.

The present invention is based on the general idea of integrating a plurality of parts of a heat exchanger in a one-piece component and thereby simplifying not only the assembly but also significantly reducing the number of joints and associated with this the potential leak points. The heat exchanger according to the invention in this case comprises a tubular housing, a flange ring, two bases as well as heat exchanger tubes which run through the housing and are each held in the bases at the side of the longitudinal end. In this case, a first flow channel is formed in the heat exchanger tubes whilst a second flow channel runs between the heat exchanger tubes and the housing. Exhaust gas for example flows in the first flow channel whereas cooling medium/coolant flows in the second flow channel. According to the invention, the housing is now formed from two, in each case one-piece and pot-shaped housing parts of which each comprises a tubular housing section, a flange ring section and a base and wherein these two housing parts can be connected to one another via the two flange ring sections to form a finished housing. In the heat exchanger according to the invention, there is thus no joining of the base or the flange ring section to a respective housing section, with the result that these joints and therefore also these potential leak points are already eliminated. As a result of the omission of these joints, the assembly process can not only be executed more rapidly but also significantly more cost-effectively.

Expediently, the flange ring section of one housing part has an external diameter which is configured to be complementary to an internal diameter of the flange ring section of the other housing part and can thus be slid into this. The housing of the heat exchanger can thus be assembled by simply connecting or joining, in particular soldering, welding, the two housing parts in the region of the respective flange ring section. Usually during a soldering, welding or general joining of the two housing parts, at the same time the inserted heat exchanger tubes held in the two bases are also soldered, welded or joined with the result that a high-quality, rapid and at the same time cost-effective manufacture is made possible.

In a further advantageous embodiment of the solution according to the invention, the heat exchanger is configured as an exhaust gas heat exchanger. Exhaust gas heat exchangers can be used for example for heating the coolant and thus for reducing the high-emission cold-start phase of an internal combustion engine wherein in addition in an exhaust gas recirculating system, exhaust gas to be recirculated can be cooled by means of the exhaust gas heat exchanger. Such an exhaust gas recirculation system in part considerably reduces the emissions of the internal combustion engine.

Expediently at least one of the housing parts is configured as a formed sheet metal stamped part and in particular is produced by deep drawing. In addition to the avoidance of the joints, it should naturally also be possible to manufacture the individual housing parts in a high-quality and cost-effective manner which can be achieved in particular by producing these as formed sheet metal stamped parts. The pot-shaped shape of the respective housing part can be achieved in particular by deep drawing.

In a further advantageous embodiment of the solution according to the invention, at least one of the housing parts has a moulded-on or attached inlet connection and/or outlet connection for coolant. Such an inlet connection or outlet connection can naturally also be configured in the manner of a diffuser and thereby bring about a uniform introduction or discharge of coolant into the housing or out from the housing. This can in particular increase the efficiency of the heat exchanger according to the invention.

The present invention is further based on the general idea of providing a housing part for a previously described heat exchanger, wherein this housing part is formed in one piece and is pot-shaped and comprises a housing wall section, a flange ring section and a base. The housing parts can be configured as identical parts with the exception of a differently configured flange ring section so that in each case two appurtenant housing parts can be slid into one another via the respective flange ring section and soldered, welded or generally joined together there. Such a housing part can in particular be configured as a cost-effective and high-quality sheet-metal stamped part, in particular for example in the deep drawing process.

Further important features and advantages of the invention are obtained from the subclaims, from the drawings and from the relevant description of the figures with reference to the drawings.

It is understood that the features mentioned previously and to be explained further hereinafter can be used not only in the respectively given combination but also in other combinations or alone without departing from the scope of the present invention.

Preferred exemplary embodiments of the invention are presented in the drawings and are explained in detail in the following description, where the same reference numbers relate to the same or similar or functionally the same components.

BRIEF DESCRIPTION OF THE DRAWINGS

In the figures, in each case schematically

Figure 1:
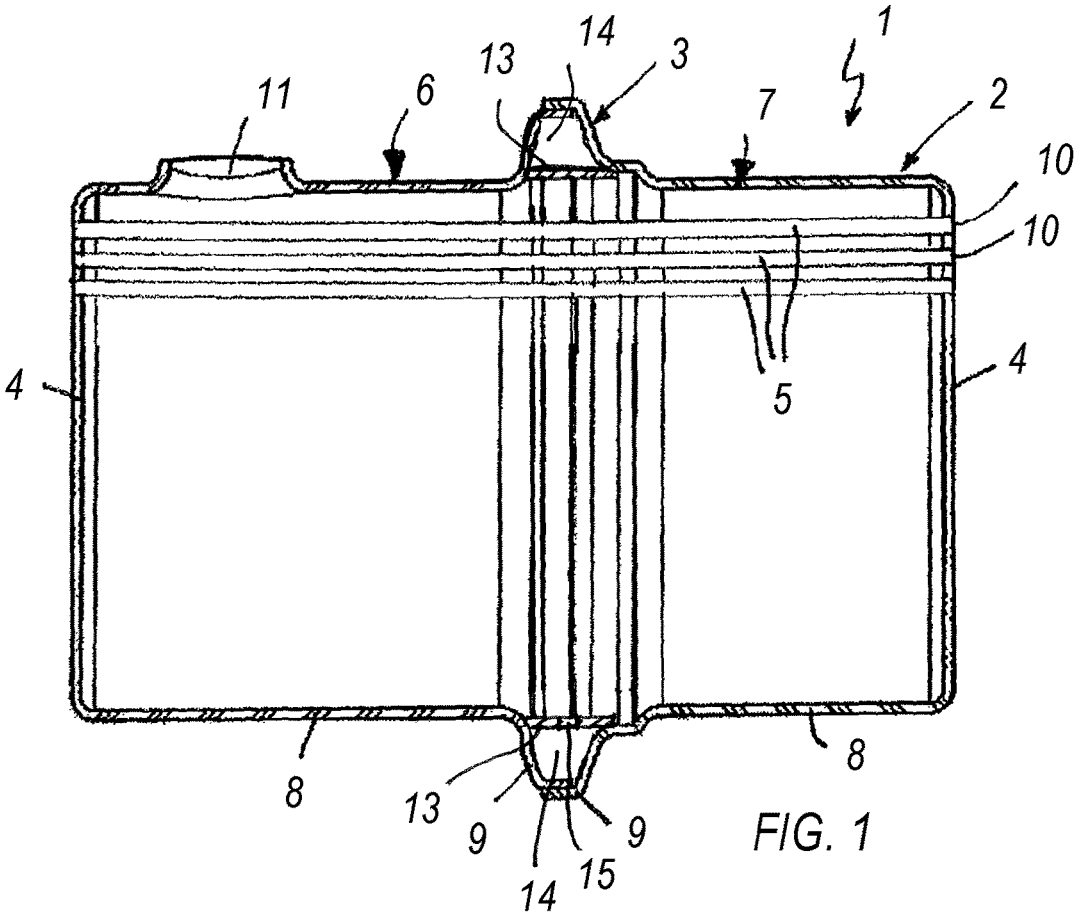
FIG. 1 shows a sectional view through a heat exchanger according to the invention in the mounted state.

According to FIG. 1, a heat exchanger 1 according to the invention, which for example can be configured as an exhaust gas heat exchanger, comprises a tubular housing 2, a flange ring 3, two bases 4 as well as heat exchanger tubes 5, wherein the heat exchanger tubes 5 run through the housing 2 and are each held in the bases 4 on the longitudinal end side. A first flow channel, for example, for exhaust gas, runs in the heat exchanger tubes 5 whilst a second flow channel, for example, for cooling medium/coolant is formed between the heat exchanger tubes 5 and the housing 2. Three heat exchanger tubes 5 are depicted in FIG. 1, wherein naturally significantly more heat exchanger tubes 5 are arranged in the heat exchanger 1 and have merely been omitted for the sake of clarity.

Figure 3:
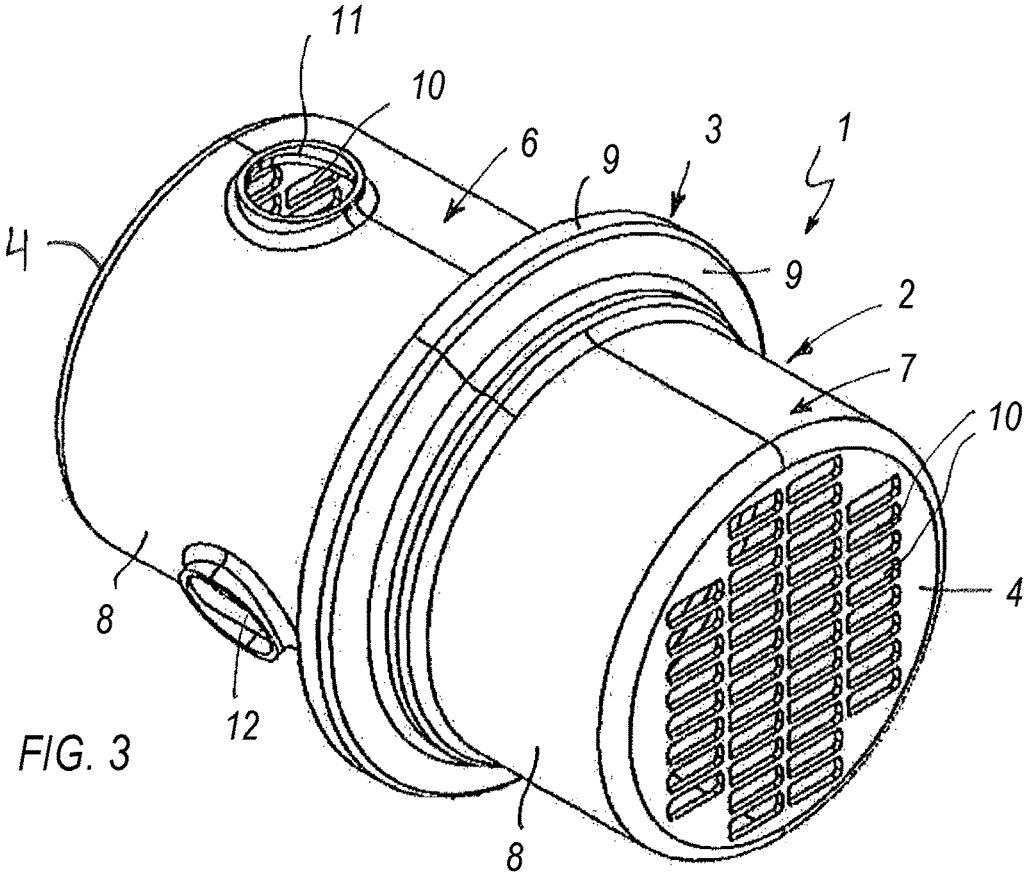
FIG. 3 shows a perspective view of a heat exchanger according to the invention.
Figure 4:
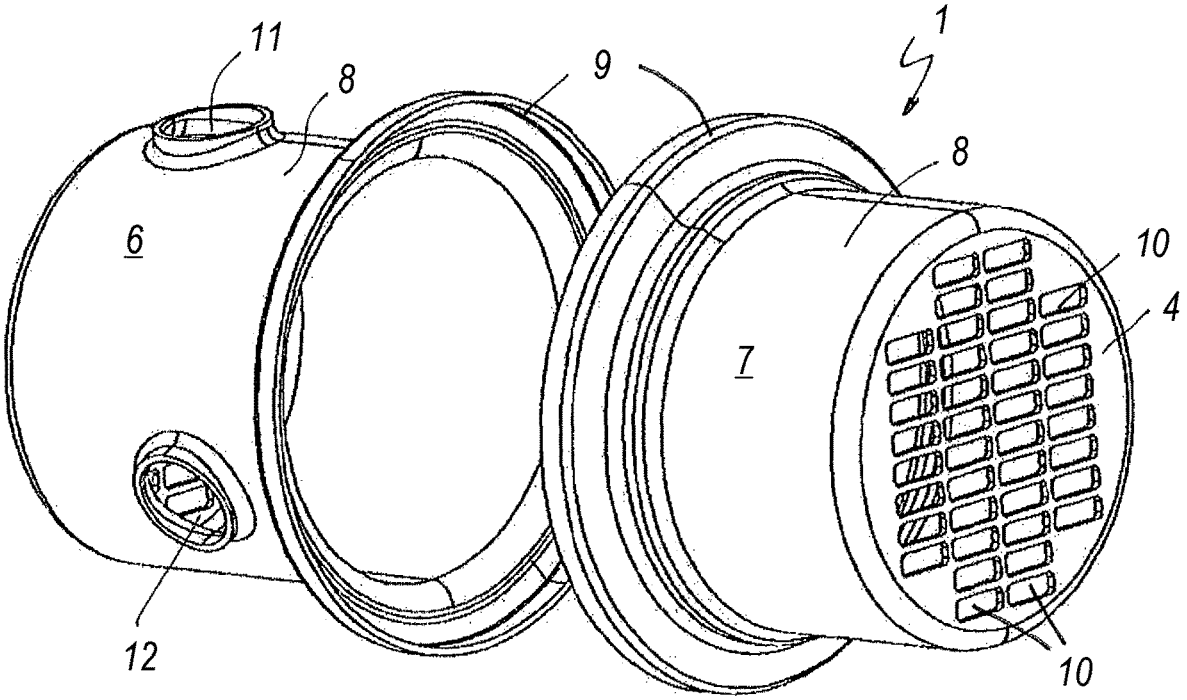
FIG. 4 shows a view as in FIG. 2 but from a perspective view.

According to the invention, the housing 2 is now composed of two, in each case one-piece and pot-shaped housing parts 6 and 7, of which each comprises a housing section 8, a flange ring section 9 and a base 4 and wherein the two housing parts 6, 7 can be joined to one another via the two flange ring sections 9. As a result of the configuration of the two housing parts 6, 7 according to the invention, in particular hitherto required joints between the bases 4 and the housing sections 8 can be omitted since these are now implemented in one piece with one another. Each of the bases 4 in this case has a row of passage openings 10 (compare FIGS. 3 and 4) in which the heat exchanger tubes 5 are held.

On examining FIG. 1, it can be seen that an at least partially hollow-cylindrical circumferential metal sheet 13 is provided inside the housing 2 in the region of the two flange ring sections 9. Alternatively a sealed cavity 14 can be arranged between the metal sheet 13 and the flange ring sections 9 or however the metal sheet 13 has openings 15 which form a passage for coolant into the cavity 14. It is also feasible that the openings 15 are configured to be round or angular with a predetermined cross-sectional area or contour so that air bubbles possibly forming in the cavity 14 can only pass with a certain (minimized) volume into the coolant. The metal sheet 13 can be fastened, for example, by welding or soldering on the inner side of the housing 2. It can separate the space through which coolant flows completely or partially in a fluid-tight manner from the circumferential cavity 14 of the flange ring section.

Figure 2:
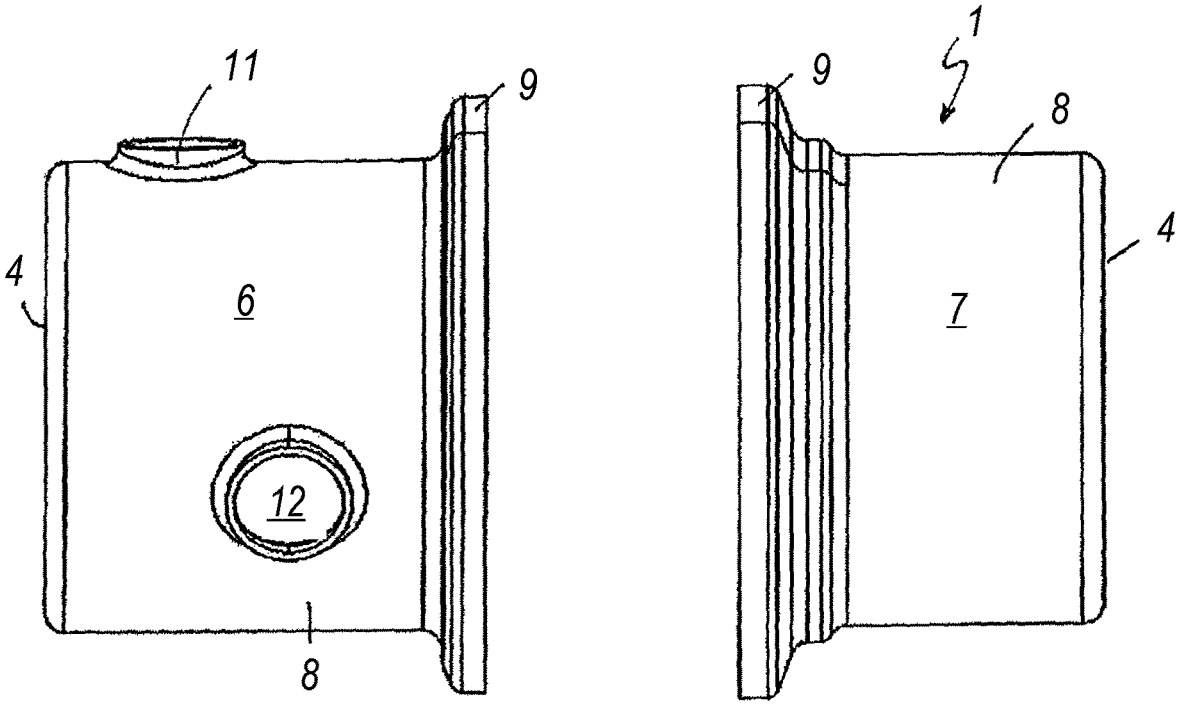
FIG. 2 shows an exploded view of the heat exchanger but without heat exchanger tubes.

If FIGS. 1 and 2 are examined once again, it can be seen that the flange ring section 9 of one housing part 6 has an external diameter which is configured to be complementary to an internal diameter of the flange ring section 9 of the other housing part 7 and can thus be slid into this. The two housing parts 6, 7 can thus be assembled by simply sliding the respective sections 9 into one another. The two housing parts 6, 7 are in this case soldered, welded or otherwise joined to one another at the flange ring sections 9 and thereby tightly connected to one another. In order to fabricate or manufacture the heat exchanger 1, the two housing halves, i.e. the two housing parts 6, 7 with the heat exchanger tubes 5 arranged therein are slid into one another and joined for example in a soldering furnace, wherein not only the joint at the two interconnected flange ring sections 9 is made but at the same time the joints between the heat exchanger tubes 5 and the bases 4.

The two housing parts 6, 7 can be configured as formed sheet metal stamped parts and in particular can be produced by deep drawing. As a result, not only simple production in terms of production technology but at the same time high-quality and cost-effective manufacture is possible. The two housing parts 6, 7 can be configured as identical parts for example with the exception of the flange ring section 9 but can also have a different axial length or additional different components such as, for example an inlet connection 11 and/or an outlet connection 12 for coolant.

With the heat exchanger 1 according to the invention or the two housing parts 6, 7, it is not only possible to reduce the number of parts and associated with this the storage and logistics costs but the production, i.e. assembly of the heat exchanger 1 can be generally simplified and improved in terms of quality. As a result of the one-piece configuration of the base 4 with the respective housing section 8 of the housing part 6, 7, a joint hitherto required and at risk of leaks between these two parts 4, 8 is omitted for example with the result that an improvement in quality not to be underestimated can be achieved.

The invention claimed is:

1. A heat exchanger comprising:

a tubular housing;

a flange ring;

two bases; and heat exchanger tubes that run through the housing and are each held in the bases at a longitudinal end side;

wherein a first flow channel is formed in the heat exchanger tubes, and a second flow channel is formed between the heat exchanger tubes and the housing;

wherein the housing is formed from two one-piece and pot-shaped housing parts, each housing part having a housing section, a flange ring section extending radially outward from the housing section, and one of the bases, the two housing parts being connectable to one another via the two flange ring sections;

wherein an end portion of each flange ring section extends in a same direction as the heat exchanger tubes, the two flange ring sections overlapping each other at the respective end portions; and wherein a cylindrical circumferential metal sheet is provided inside the housing where the two flange ring sections connect the two housing parts, a cavity being arranged between the metal sheet and the flange ring sections, the cavity extending from the metal sheet to the flange ring sections.

2. The heat exchanger according to claim 1, wherein the flange ring section of one housing part has an external diameter configured to be complementary to an internal diameter of the flange ring section of the other housing part such that the one housing part is slidable into the other housing part.

3. The heat exchanger according to claim 2, wherein the two housing parts are one of soldered, welded, or joined to one another at the flange ring sections.

4. The heat exchanger according to claim 2, wherein the heat exchanger is configured as an exhaust gas heat exchanger.

5. The heat exchanger according to claim 2, wherein at least one of the housing parts is configured as a formed sheet metal stamped part produced by deep drawing.

6. The heat exchanger according to claim 2, wherein at least one of the housing parts has at least one of an inlet connection and an outlet connection for coolant and that is one of moulded on or attached to the respective housing section of the at least one of the housing parts.

7. The heat exchanger according to claim 1, wherein the two housing parts are one of soldered, welded, or joined to one another at the flange ring sections.

8. The heat exchanger according to claim 1, wherein the heat exchanger is configured as an exhaust gas heat exchanger.

9. The heat exchanger according to claim 1, wherein at least one of the housing parts is configured as a formed sheet metal stamped part produced by deep drawing.

10. The heat exchanger according to claim 1, wherein at least one of the housing parts has at least one of an inlet connection and an outlet connection for coolant and that is one of moulded on or attached to the respective housing section of the at least one of the housing parts.

11. The heat exchanger according to claim 10, wherein the inlet connection and the outlet connection are in the same housing part.

12. The heat exchanger according to claim 1, wherein the cavity is sealed.

13. The heat exchanger according to claim 1, wherein the metal sheet has openings forming a passage for coolant into or out of the cavity.

14. A heat exchanger comprising:

a tubular housing formed from two one-piece and pot-shaped housing parts, each housing part having a housing section, a flange ring section extending radially outward from the housing section, a base, and inlet and outlet connections one of moulded on or attached to the tubular housing section, the two housing parts being connectable to one another via the two flange ring sections;

a cylindrical circumferential metal sheet that is inside the housing where the two flange ring sections connect the two housing parts, a sealed cavity being arranged between the metal sheet and the flange ring sections, the metal sheet and the flange ring sections defining the cavity; and heat exchanger tubes that run through the housing and are each held in the base of each housing part at a longitudinal end side of each heat exchanger tube;

wherein a first flow channel is formed in the heat exchanger tubes, and a second flow channel is formed between the heat exchanger tubes and the housing.

* * * * *